US007916097B2

(12) United States Patent
Nilsson

(10) Patent No.: US 7,916,097 B2
(45) Date of Patent: Mar. 29, 2011

(54) ENHANCED BAND MULTIPLE POLARIZATION ANTENNA ASSEMBLY

(75) Inventor: Jack Nilsson, Medina, OH (US)

(73) Assignee: MP Antenna, North Ridgeville, OH (US)

( * ) Notice: Subject to any disclaimer, the term of this patent is extended or adjusted under 35 U.S.C. 154(b) by 492 days.

(21) Appl. No.: 12/127,735

(22) Filed: May 27, 2008

(65) Prior Publication Data

US 2009/0295668 A1 Dec. 3, 2009

(51) Int. Cl.
*H01Q 21/00* (2006.01)

(52) U.S. Cl. ..... 343/893

(58) Field of Classification Search ..... 343/893, 343/711–715, 789, 840, 700 MS
See application file for complete search history.

(56) References Cited

U.S. PATENT DOCUMENTS

| | | | | |
|---|---|---|---|---|
| 4,253,099 | A * | 2/1981 | Yamazaki et al. | 343/713 |
| 4,788,551 | A * | 11/1988 | Ishida | 343/713 |
| 5,177,493 | A * | 1/1993 | Kawamura | 343/713 |
| 6,198,454 | B1 | 3/2001 | Sharp et al. | |
| 6,486,849 | B2 | 11/2002 | Buckles | |
| 6,940,457 | B2 | 9/2005 | Lee et al. | |
| 7,358,909 | B2 * | 4/2008 | Sherwood | 343/713 |
| 2003/0122719 | A1 | 7/2003 | Nilsson et al. | |
| 2004/0164917 | A1 | 8/2004 | Nilsson | |
| 2004/0164918 | A1 | 8/2004 | Nilsson | |
| 2007/0046548 | A1 | 3/2007 | Pros et al. | |
| 2007/0152894 | A1 | 7/2007 | Sanz et al. | |

FOREIGN PATENT DOCUMENTS

| | | |
|---|---|---|
| EP | 0 225 460 A2 | 6/1987 |
| GB | 1 223 778 | 3/1971 |

* cited by examiner

*Primary Examiner* — Huedung Mancuso
(74) *Attorney, Agent, or Firm* — Tarolli, Sundheim, Covell & Tummino LLP

(57) ABSTRACT

An antenna assembly is provided for receiving and transmitting radio frequency signals over an enhanced frequency band. A first radiative element has a first end, a second end, and an associated length, and is comprised of an electrically conductive material. The first end of the first radiative element is electrically connected to an antenna feed at an apex and at least a portion of the first radiative element is disposed outwardly away from the apex at an acute angle relative to, and on a first side of, an imaginary plane intersecting the apex. A second radiative element has a first end and a second end and is comprised of an electrically conductive material. The first end of the second radiative element is electrically connected to the antenna feed and the first radiative element at the apex. The second end of the second radiative element has an associated height above the imaginary plane that is less than the product of the length of the first element and the sine of the acute angle at which the first element is disposed outwardly from the apex. The assembly further comprises an electrically conductive ground reference.

20 Claims, 2 Drawing Sheets

ENHANCED BAND MULTIPLE POLARIZATION ANTENNA ASSEMBLY

RELATED APPLICATIONS

This application claims priority from pending U.S. application Ser. No. 11/279,941, filed Apr. 17, 2006 and published as U.S. Published Patent Application No. 2007/0132651 which is a divisional of patent application Ser. No. 10/786,656, filed on Feb. 25, 2004, now U.S. Pat. No. 7,030,831, issued Apr. 18, 2006, which was a continuation-in-part of patent application Ser. No. 10/294,420 filed on Nov. 14, 2002, now U.S. Pat. No. 6,806,841 which issued on Oct. 19, 2004. Each of these documents are incorporated herein by reference in their entirety.

Further the subject matter of each of U.S. Pat. No. 7,348,933, issued Mar. 25, 2008, U.S. Pat. No. 7,236,129, issued Jun. 26, 2007, U.S. Pat. No. 7,138,956, issued Nov. 21, 2006, and U.S. Pat. No. 6,496,152, issued Dec. 17, 2002, is incorporated herein by reference.

TECHNICAL FIELD

Certain embodiments of the present invention relate to antennas for wireless communications. More particularly, certain embodiments of the present invention relate to an apparatus and method providing a multi-band, wide-band, or broadband multi-polarized antenna exhibiting substantial spatial diversity for use in point-to-point and point-to-multi-point communication applications for the Internet, land, maritime, aviation, and space.

BACKGROUND OF THE INVENTION

For years, wireless communications have struggled with limitations of audio/video/data transport and internet connectivity in both obstructed (indoor/outdoor) and line-of-site (LOS) deployments. A focus on antenna gain as well as circuitry solutions have proven to have significant limitations. Unresolved, non-optimized (leading edge) technologies have often given way to "bleeding edge" attempted resolutions. Unfortunately, all have fallen short of desirable goals.

While lower frequency radio waves benefit from an 'earth hugging' propagation advantage, higher frequencies do inherently benefit from (multi-) reflection/penetrating characteristics. However, with topographical changes (hills & valleys) and object obstructions (e.g., natural such as trees, and man-made such as buildings/walls) and with the resultant reflections, diffractions, refractions and scattering, maximum signal received may well be off-axis (non-direct path) and multi-path (partial) cancellation of signals results in null/weaker spots. Also, some antennas may benefit from having gain at one elevation angle ('capturing' signals of some pathways), while other antennas have greater gain at another elevation angle, each type being insufficient where the other does well. In addition, the radio wave can experience altered polarizations as they propagate, reflect, refract, diffract, and scatter. A very preferred (polarization) path may exist; however, insufficient capture of the signal can result if this preferred path is not utilized.

BRIEF SUMMARY OF THE INVENTION

In accordance with an aspect of the invention, an antenna assembly is provided for receiving and transmitting radio frequency signals over an enhanced frequency band. A first radiative element has a first end, a second end, and an associated length, and is comprised of an electrically conductive material. The first end of the first radiative element is electrically connected to an antenna feed at an apex and at least a portion of the first radiative element is disposed outwardly away from the apex at an acute angle relative to, and on a first side of, an imaginary plane intersecting the apex. A second radiative element has a first end and a second end and is comprised of an electrically conductive material. The first end of the second radiative element is electrically connected to the antenna feed and the first radiative element at the apex. The second end of the second radiative element has an associated height above the imaginary plane that is less than the product of the length of the first element and the sine of the acute angle at which the first element is disposed outwardly from the apex. The assembly further comprises an electrically conductive ground reference.

In accordance with another aspect of the invention, an antenna assembly is provided for receiving and transmitting radio frequency signals over an enhanced frequency band. The antenna assembly comprises an electrically conductive ground reference. A first set of a plurality of curvilinear radiative elements are each electrically connected at respective first ends to an antenna feed at an apex and are comprised of an electrically conductive material. At least a portion of each of the first set of radiative elements are disposed outwardly away from the apex on a first side of the imaginary plane. Each of the first set of curvilinear elements having a length are tuned to a first characteristic frequency and curved such that respective second ends of the first set of radiative elements are located below a predetermined height above the imaginary plane.

In accordance with yet another aspect of the present invention, an antenna assembly is provided for receiving and transmitting radio frequency signals over an enhanced frequency band. A set of a plurality of radiative elements are each electrically connected to an antenna feed at an apex and comprised of an electrically conductive material, At least a portion of each of the set of radiative elements are disposed outwardly away from the apex at an acute angle relative to, and on a first side of the imaginary plane. Each of the set of radiative elements has a length within a first range associated with a first characteristic frequency, such that the associated lengths of the set of radiative elements are selected as to tune the antenna to the first characteristic frequency.

A second set of a plurality of radiative elements are each electrically connected to the antenna feed at the apex and comprised of an electrically conductive material. At least a portion of each of the second set of radiative elements is disposed outwardly away from the apex at an acute angle relative to, and on a first side of the imaginary plane. Each of the second set of radiative elements has a length within a second range that does not overlap the first range. The assembly further comprises an electrically conductive ground reference.

DETAILED DESCRIPTION OF THE INVENTION

Figure 1:
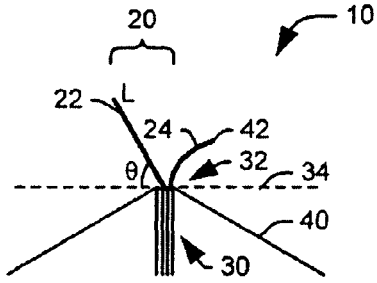
FIG. 1 illustrates an enhanced band, multi-polarized antenna for transmitting and receiving radio frequency signals in accordance with various aspects of the present invention.

Generally stated, a novel three-dimensionally constructed antenna with in-built spatial diversity (one part perhaps in a "null spot," while another part of the antenna in a: "hot spot"), relatively broad signal patterning, and in-built polarization diversity serves to stabilize signal and throughput (minimizing Ethernet rejects and the like) in the real "obstructed," often dynamic world. FIG. 1 illustrates a first embodiment of an enhanced band, multi-polarized antenna 10 for transmitting and receiving radio frequency signals in accordance with various aspects of the present invention. It will be appreciated that the term "radio frequency," is intended to encompass frequencies within the microwave and traditional radio bands, specifically frequencies between 3 kHz and 3 THz. Further, the term "enhanced band" is intended to refer to wideband and multiband applications. The antenna comprises a multi-polarized driven assembly 20 that includes at least a first radiative element 22 and a second radiative element 24, each formed from a conductive material. The two radiative elements 22 and 24 of the driven element 20 have respective first ends are electrically connected to one another and an antenna feed 30 at an apex point 32 such that the radiative elements 22 and 24 each extend to respective second ends. In accordance with an aspect of the invention, at least a portion of the first radiative element extends outwardly from the apex point at an acute angle, that is an angle less than ninety degrees, relative to an imaginary plane 34 intersecting the apex point 32. The radiative elements 22 and 24 are all located to a first side of the imaginary plane 34. It will be appreciated that additional radiative elements (not shown) can be utilized in the driven element in accordance with various implementations of the invention.

Electromagnetic waves are often reflected, diffracted, refracted, and scattered by surrounding objects, both natural and man-made. As a result, electromagnetic waves that are approaching a receiving antenna can be arriving from multiple angles and have multiple polarizations and signal levels. The antenna 10 illustrated in FIG. 1 is configured to capture or utilize the preferred approaching signal whether the preferred signal is a line-of-sight (LOS) signal or a reflected signal, and no matter how the signal is polarized. In the illustrated antenna 10, the multiple radiative members 22 and 24 are positioned over a ground plane and properly spaced to allow signals of diverse polarizations to generated and/or received in various different directions. Therefore, such a driven element is said to be "multi-polarized" as well as providing "geometric spatial capture of signal". If a driven element produced all polarizations in all planes (e.g., all planes in an x, y, z coordinate system) and the receiving antenna is capable of capturing all polarizations in all planes, then the significantly greatest preferred polarization path, that is the signal path allowing for maximum signal amplitude, may be utilized, as well as well as a variety of polarization diverse and spatially diverse resultant signals.

A conductive ground plane structure 40 can be located at the imaginary plane or on a second side of the imaginary plane 34. The ground plane structure 40 is illustrated herein as a conical member, but it will be appreciated that the ground plane structure can be configured in any of a number of ways. For example, a planar or cylindrical ground plane can be utilized. Further, the ground plane structure 40 does not need to be a single, solid structure. For example, the ground plane can be implemented as a conductive mesh or comprise a number of discrete conductive elements evenly spaced around the apex point 32.

In accordance with an embodiment of the present invention, the first radiative antenna element 22 can have a length, L, and an angle of incidence, θ, with the imaginary plane 34. The second radiative antenna element 24 can be configured such that a second end 42 of the second radiative element is at a height, H, above the imaginary plane 34 that is less than the product of the length of the first antenna element 22 and the sine of the angle of incidence, such that:

$$H<L\sin(\theta) \qquad \text{Eq. 1}$$

By maintaining the height of the second end 42 of the second radiative element 24 below this level, it is possible to introduce enhanced band sensitivity to the antenna assembly without significantly increasing the size and complexity of the antenna assembly.

Figure 2:
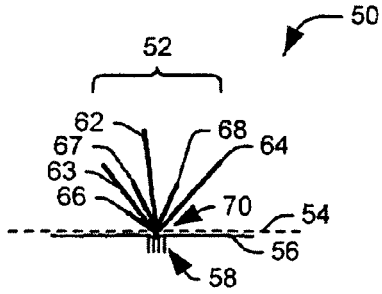
FIG. 2 illustrates a side view of a first exemplary implementation of an antenna assembly in accordance with an aspect of the present invention.

FIG. 2 illustrates a side view of a first exemplary implementation of an antenna assembly 50 in accordance with an aspect of the present invention.

Figure 3:
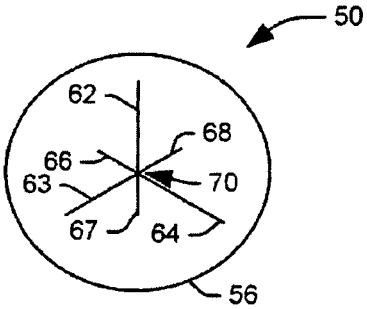
FIG. 3 illustrates an overhead view of a first exemplary implementation of an antenna assembly in accordance with an aspect of the present invention.

FIG. 3 illustrates an overhead view of the first exemplary implementation of the antenna assembly. The illustrated antenna assembly 50 comprises a driven antenna assembly 52 located on a first side of an imaginary plane 54, and a ground reference 56 located at the imaginary plane or on a second side of the imaginary plane. The driven antenna assembly 52 can be driven by an antenna feed that is electrically connected to the driven antenna assembly approximately at the imaginary plane 54. In the illustrated implementation, the ground reference 56 is illustrated as planar, but it will be appreciated that other configurations of the ground plane can be utilized within the illustrated antenna assembly. The ground reference 56 may be comprised of any appropriate electrically conductive material such as, for example, copper or stainless steel. The radius of the ground reference 56 is at least one-quarter of a wavelength of the lowest frequency of operation.

The surface of the ground reference 56 may be continuous or may be a crosshatched wired mesh, in accordance with various embodiments of the present invention. Also, three or more linear elements disposed in a substantially conical shape may form the ground reference, in accordance with an embodiment of the present invention. In other implementations, the ground reference 56 can include a conical assembly or a cylindrical sleeve having a closed upper base side. Alternatively, the shield of a coaxial associated with the antenna feed can serve as the ground reference, and various styles of stubs, sleeves, matching systems, baluns, transformers, etc. may also be used. The antenna feed 58 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect to the driven antenna assembly 52 and allows a ground braid of the coaxial cable to electrically connect to the ground reference 56. A dielectric material can be used to electrically insulate the center conductor and the driven antenna assembly 52 from the ground reference 56.

The driven antenna assembly 52 comprises six radiative elements 62-64 and 66-68 that radiate out from a common apex 70. The driven antenna assembly 52 and its constituent elements 62-64 and 66-68 are formed from a conductive material. The radiative elements 62-64 and 66-68 are electrically connected to the antenna feed 58 and one another at the apex 70. A first set of radiative elements comprise first, second, and third radiative elements 62-64 that are generally linear and extend away from the apex 70 at an acute angle relative to the imaginary plane 54. Each of the first, second, and third radiative antenna elements 62-64 may be at a unique acute angle or at the same acute angle relative to the imaginary plane 54. In the illustrated implementation, the first, second, and third radiative elements 62-64 are oriented such that the first, second, and third elements are spaced evenly, that is, at intervals of one-hundred and twenty degrees. Each of the first set of radiative elements 62-64 have a length within a first range of lengths associated with a first characteristic frequency. For example, a first element 62 can have a length, $L_1$, tuned to be receptive to the first characteristic frequency and each of the second and third elements 63 and 64 can have a length within an approximately ten percent variance of the length of the first element. Varying the lengths of the first set of radiative elements 62-64 can provide an improvement in the broadband properties of the driven antenna assembly, but it will be appreciated that a common antenna length, for example, the tuned antenna length $L_1$, can be utilized for the first set of radiative elements in while still maintain the wideband properties of the antenna.

A second set of radiative elements comprise fourth, fifth, and sixth radiative elements 66-68 that are generally linear and extend away from the apex 70 at an acute angle relative to the imaginary plane 54. Each of the fourth, fifth, and sixth radiative antenna elements 66-68 may be at a unique acute angle or at the same acute angle relative to the imaginary plane 54 as one another or one of the first set of radiative elements 62-64. In the illustrated implementation, the fourth, fifth, and sixth radiative elements 66-68 are oriented such that they are spaced evenly between the first set of radiative elements 62-64, such that each of the second set of radiative elements is spaced at sixty degree intervals from two of the first set of radiative elements and at intervals of one-hundred and twenty degrees from one another. Each of the second set of radiative elements 66-68 have a length within a second range of lengths associated with a second characteristic frequency. For example, the fourth element 66 can have a length, $L_2$, tuned to be receptive to the second characteristic frequency and each of the fifth and sixth elements 67 and 68 can have a length within an approximately ten percent variance of the length of the fourth element. The lengths of the radiative elements 62-64 and 66-68 can be configured such that the first range of lengths and the second range of lengths do not overlap.

In the illustrated implementation, the antenna assembly 50 is designed with a first characteristic frequency of 2.4 GHz and a second characteristic frequency of 5 GHz, allowing the antenna to operate at a wide band of radio frequencies ranging from approximately 2.0 GHz to approximately 11 GHz. The lengths of the first set of radiative elements 62-64 can be tuned to a frequency of 2.4 GHz, with the first radiative element 62 having a length of approximately 0.875 inches, the second radiative element 63 being shorter by a factor less than ten percent (e.g., ~0.813 inches) and the third radiative element 64 can longer by a factor less than ten percent (e.g., 0.938 inches). The lengths of the second set of radiative elements 66-68 can be tuned to a frequency of 5 GHz, such that the fourth radiative element 66 has a length of approximately 0.563 inches, the fifth radiative element 67 can be shorter by a factor less than ten percent (e.g., ~0.5 inches) and the sixth radiative element 68 can be longer by a factor of less than ten percent (e.g., 0.625 inches). Each of the radiative elements can have a diameter of approximately one-sixteenth of an inch. By implementing the driven antenna assembly 52 as a series of elements of varying lengths, an ultra wide band, multi-polarized antenna assembly can be realized.

In accordance with an aspect of the present invention, each of the first and second sets of radiative elements 62-64 and 66-68 can be generalized to only two or greater than three elements having similar length and orientation. For example, in place of the first set of radiative elements 62-64, four radiative elements, circumferentially spaced at intervals of ninety degrees, or otherwise, may be used. In fact, in one implementation, the first and second sets of radiative elements 62-64 and 66-68 may be effectively replaced with a continuous surface of a cone, a pyramid, or some other continuous shape that is spatially diverse on one side (e.g., has significant spatial extent) and comes substantially to a point (e.g., an apex) on the other side. For example, in accordance with an aspect of the present invention, a linear radiative member connected at one end to a radiative loop having a certain spatial extend may be used.

Figure 4:
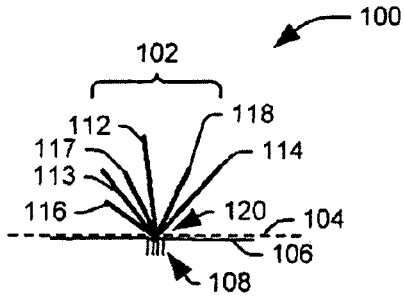
FIG. 4 illustrates a side view of a second exemplary implementation of an antenna assembly in accordance with an aspect of the present invention.

FIG. 4 illustrates a side view of a second exemplary implementation of an antenna assembly 100 in accordance with an aspect of the present invention.

Figure 5:
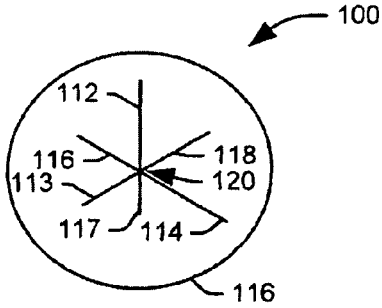
FIG. 5 illustrates an overhead view of a second exemplary implementation of an antenna assembly in accordance with an aspect of the present invention.

FIG. 5 illustrates an overhead view of the second exemplary implementation of the antenna assembly. The illustrated antenna assembly 100 comprises a driven antenna assembly 102 located on a first side of an imaginary plane 104, and a ground reference 106 located at the imaginary plane or on a second side of the imaginary plane. The driven antenna assembly 102 can be driven by an antenna feed that is electrically connected to the driven antenna assembly approximately at the imaginary plane 104. In the illustrated implementation, the ground reference 106 is illustrated as planar, but it will be appreciated that other configurations of the ground plane can be utilized within the illustrated antenna assembly. The ground reference 106 may be comprised of any appropriate electrically conductive material such as, for example, copper or stainless steel. The radius of the ground reference 106 is at least one-quarter of a wavelength associated with the lowest frequency of operation.

The surface of the ground reference 106 may be continuous or may be a crosshatched wired mesh, in accordance with various embodiments of the present invention. Also, three or more linear elements disposed in a substantially conical shape may form the ground reference, in accordance with an embodiment of the present invention. In other implementations, the ground reference 106 can include a conical assembly or a cylindrical sleeve having a closed upper base side. Alternatively, the shield of a coaxial associated with the antenna feed can serve as the ground reference, and various styles of stubs, sleeves, matching systems, baluns, transformers, etc. may also be used. The antenna feed 108 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 102 and allows a ground braid of the coaxial cable to electrically connect to the ground reference 106. A dielectric material can be used to electrically insulate the center conductor and the driven antenna assembly 102 from the ground reference 106.

The driven antenna assembly 102 comprises six radiative elements 112-114 and 116-118 that radiate out from a common apex 120. The driven antenna assembly 102 and its constituent elements 112-114 and 116-118 are formed from a conductive material. The radiative elements 112-114 and 116-118 are electrically connected to the antenna feed 108 and one another at the apex 120. A first set of radiative elements comprise first, second, and third radiative elements 112-114 that are generally linear and extend away from the apex 120 at an acute angle relative to the imaginary plane 104. Each of the first, second, and third radiative antenna elements 112-114 may be at a unique acute angle or at the same acute angle relative to the imaginary plane 104. In the illustrated implementation, the first, second, and third radiative elements 112-114 are oriented such that the first, second, and third elements are spaced evenly, that is, at intervals of one-hundred and twenty degrees. Each of the first set of radiative elements 112-114 have a length within a first range of lengths associated with a characteristic lower bound frequency. For example, a first element 112 can have a length, $L_1$, tuned to be receptive to the characteristic lower bound frequency and each of the second and third elements 113 and 114 can have a length within an approximately ten percent variance of the length of the first element. Varying the lengths of the first set of radiative elements 112-114 can provide an improvement in the broadband properties of the driven antenna assembly, but it will be appreciated that a common antenna length, for example, the tuned antenna length $L_1$, can be utilized for the first set of radiative elements in while still maintain the wideband properties of the antenna.

A second set of radiative elements comprise fourth, fifth, and sixth radiative elements 116-118 that are generally linear and extend away from the apex 120 at an acute angle relative to the imaginary plane 104. Each of the fourth, fifth, and sixth radiative antenna elements 116-118 may be at a unique acute angle or at the same acute angle relative to the imaginary plane 104 as one another or one of the first set of radiative elements 112-114. In the illustrated implementation, the fourth, fifth, and sixth radiative elements 116-118 are oriented such that they are spaced evenly between the first set of radiative elements 112-114, such that each of the second set of radiative elements is spaced at sixty degree intervals from two of the first set of radiative elements and at intervals of one-hundred and twenty degrees from one another. Each of the second set of radiative elements 116-118 have a length in a second range around a length of approximately four-fifths the tuned length associated with the characteristic frequency. In one implementation, the length of each of the second set of radiative elements 116-118 can be equal to four-fifths the length of a corresponding one of the first set of radiative elements 112-114.

In the illustrated implementation, the antenna assembly 100 is designed with a characteristic lower bound frequency around 700 MHz, and the lengths of the first set of radiative elements 112-114 selected as to tune the antenna to that frequency. In the illustrated implementation, the first radiative element 112 can have a length of approximately 3.19 inches, the second radiative element 113 can have a length of approximately 2.88 inches, and the third radiative element 114 can have a length of approximately 3.25 inches). The lengths of the second set of radiative elements 116-118 can be cut to approximately four-fifths the length of the first set of radiative elements 112-114. Accordingly, the fourth radiative element 116 can have a length of around 2.56 inches, the fifth radiative element 117 can have a length on the order of 2.31 inches, and the sixth radiative element 118 can have a length of approximately 2.63 inches. Each element 112-114 can have a diameter of approximately one-sixteenth of an inch, and the planar ground reference 106 can have a diameter of eleven inches. The illustrated antenna 100 can operate at an extremely wide band of radio frequencies ranging from approximately 700 MHz to approximately 6 GHz.

In accordance with an aspect of the present invention, each of the first and second sets of radiative elements 112-114 and 116-118 can be generalized to only two or greater than three elements having similar length and orientation. For example, in place of the first set of radiative elements 112-114, four radiative elements, circumferentially spaced at intervals of ninety degrees, or otherwise, may be used. In fact, the first and second sets of radiative elements 112-114 and 116-118 may be effectively replaced with a continuous surface of a cone, a pyramid, or some other continuous shape that is spatially diverse on one side (e.g., has significant spatial extent) and comes substantially to a point (e.g., an apex) on the other side. For example, in accordance with an aspect of the present invention, a linear radiative member connected at one end to a radiative loop having a certain spatial extend may be used.

Figure 6:
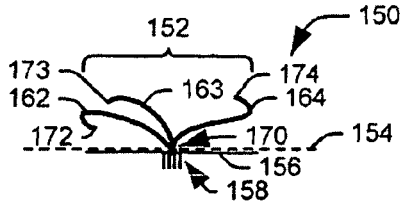
FIG. 6 illustrates a side view of a third exemplary implementation of an antenna assembly in accordance with an aspect of the present invention.

FIG. 6 illustrates a side view of a third exemplary implementation of an antenna assembly 150 in accordance with an aspect of the present invention. The illustrated antenna assembly 150 comprises a driven antenna assembly 152 located on a first side of an imaginary plane 154, and a ground reference 156 located at the imaginary plane or on a second side of the imaginary plane. The driven antenna assembly 152 can be driven by an antenna feed that is electrically connected to the driven antenna assembly approximately at the imaginary plane 154. In the illustrated implementation, the ground reference 156 is illustrated as planar, but it will be appreciated that other configurations of the ground plane can be utilized within the illustrated antenna assembly. The ground reference 156 may be comprised of any appropriate electrically conductive material such as, for example, copper or stainless steel. The antenna feed 158 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 152 and allows a ground braid of the coaxial cable to electrically connect to the ground reference 156. A dielectric material can be used to electrically insulate the center conductor and the driven antenna assembly 152 from the ground reference 156.

The driven antenna assembly 152 comprises three radiative elements 162-164 that spiral outward from a common apex 170. It will be appreciated, however, that one element, two elements, or more than three elements can also be utilized. The driven antenna assembly 152 and its constituent elements 162-164 are formed from a conductive material. The radiative elements 162-164 are electrically connected to the antenna feed 158 and one another at respective first ends at the apex 170. Each of the radiative elements 162-164 are curvilinear and radiate away from the apex 170. In the illustrated implementation, the first, second, and third radiative elements 162-164 are oriented such that the first, second, and third elements are spaced evenly as they leave the apex 170, that is, at intervals of one-hundred and twenty degrees.

Each of the first set of radiative elements 162-164 has a length within a first range of lengths associated with a first characteristic frequency. It will be appreciated that length, as used herein, refers to the straightened length of the element, as opposed to the distance it extend from the apex 170. For example, a first element 162 can have a length, $L_1$, tuned to be receptive to the first characteristic frequency and each of the second and third elements 163 and 164 can have a length within an approximately ten percent variance of the length of the first element. Varying the lengths of the radiative elements 162-164 can provide an improvement in the broadband properties of the driven antenna assembly, but it will be appreciated that a common antenna length, for example, the tuned antenna length $L_1$, can be utilized for the first set of radiative elements in while still maintain the enhanced band properties of the antenna.

In accordance with an aspect of the present invention, the radiative elements 162-164 can be curved such that respective second ends 172-174 of the radiative elements are located at a predetermined height above the ground reference 156. This height can be selected to be approximately one-quarter of a wavelength associated with a second characteristic frequency. The rate of ascent of the curvilinear elements 162-164 can be relatively high until this height is approached and then significantly slowed to maximize the length of the curvilinear element at or near this height. By curving the curvilinear elements 162-164 in this manner, an additional degree of capacitive and inductive coupling between the elements 162-164 and the ground reference 156 can be established, allowing the antenna increased sensitivity around the second characteristic frequency. Accordingly, the illustrated antenna assembly 150 is sensitive to frequencies in bands around both the first characteristic frequency and the second characteristic frequency, allowing for true dual-band operation from a single driven radiative assembly.

In accordance with an aspect of the present invention, the polarization diversity of the antenna assembly 150 around the horizon can be greatly enhanced through the use of the curvilinear elements 162-164. In the illustrated antenna assembly 150, the radiation pattern includes alternating horizontally and vertically polarized lobes around the horizon of the pattern, allowing the antenna to be responsive to multiple polarizations even at a low elevation. This alternating horizontal and vertical polarization is particularly useful in dynamic environments and mobile applications. The use of the curvilinear elements 162-164 also allows for a significant reduction in the size of the ground reference 156, such that the radius of the ground reference can be significantly smaller than one-quarter of the wavelength associated with the lowest frequency of operation.

In the illustrated implementation, the antenna assembly 150 is designed to operate in a first band around 800 MHz and a second band around 1.8 GHz to 1.9 GHz. To this end, the lengths of the curvilinear radiative elements 162-164 can be as to tune the antenna to a frequency of 800 MHz. Accordingly, the first curvilinear element 162 can have a length of approximately 4 inches, the second curvilinear element 163 can have a length of approximately 4.13 inches, and the third curvilinear element 214 can have a length of approximately 3.44 inches. The height of each of the second ends 172-174 of the curvilinear elements 162-164 above the ground reference 156 can range around one-quarter of a wavelength corresponding to a frequency of 1.8 GHz. It has been determined in implementing the illustrated antenna that a height of approximately 1.75 inches for the second ends 172-174 of the curvilinear elements 162-164 allows for operation in the 1.8 GHz-1.9 GHz band.

Figure 7:
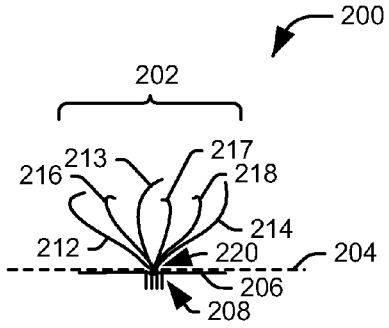
FIG. 7 illustrates a side view of a fourth exemplary implementation of an antenna assembly in accordance with an aspect of the present invention.

FIG. 7 illustrates a side view of a fourth exemplary implementation of an antenna assembly 200 in accordance with an aspect of the present invention. The illustrated antenna assembly 200 comprises a driven antenna assembly 202 located on a first side of an imaginary plane 204, and a ground reference 206 located at the imaginary plane or on a second side of the imaginary plane. The driven antenna assembly 202 can be driven by an antenna feed that is electrically connected to the driven antenna assembly approximately at the imaginary plane 204. In the illustrated implementation, the ground reference 206 is illustrated as planar, but it will be appreciated that other configurations of the ground plane can be utilized within the illustrated antenna assembly. The ground reference 206 may be comprised of any appropriate electrically conductive material such as, for example, copper or stainless steel. The antenna feed 208 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 202 and allows a ground braid of the coaxial cable to electrically connect to the ground reference 206. A dielectric material can be used to electrically insulate the center conductor and the driven antenna assembly 202 from the ground reference 206.

The driven antenna assembly 202 comprises a first set of three radiative elements 212-214 and a second set of radiative elements 216-218 that spiral outward from a common apex 220. It will be appreciated, however, that one element, two elements, or more than three elements can also be utilized in each set. The driven antenna assembly 202 and its constituent elements 212-214 and 216-218 are formed from a conductive material. The radiative elements 212-214 and 216-218 are electrically connected to the antenna feed 208 and one another at respective first ends at the apex 220. Each of the radiative elements 212-214 and 216-218 are curvilinear and radiate away from the apex 220. In the illustrated implementation, the curvilinear elements extend away from the apex 220 near a desired horizontal radius from the apex at a first rate of ascent, and tend proceed at a second rate of ascent, greater than the first rate of ascent. In the illustrated implementation, this is accomplished without any change to the sign of the curvature; the direction of concavity of the element does not change. Accordingly, the maximum horizontal extent of the curvilinear elements, and thus, the radius of the ground reference 206, can be limited without a significant loss of sensitivity in the lower frequency portion of the band. It will be appreciated, however, that due to the curvature of the curvilinear elements, the height of the curvilinear elements will also be limited, lowering the overall profile of the antenna assembly.

In the illustrated implementation, the first, second, and third radiative elements 212-214 are oriented such that the first, second, and third elements are spaced evenly as they leave the apex 220, that is, at intervals of one-hundred and twenty degrees. The fourth, fifth, and sixth radiative elements

216-218 are oriented such that they are spaced evenly between the first set of radiative elements 212-214, such that each of the second set of radiative elements is spaced at sixty degree intervals from two of the first set of radiative elements as they leave the apex and at intervals of one-hundred and twenty degrees from one another.

Each of the first set of radiative elements 212-214 has a length within a first range of lengths associated with a first characteristic frequency. It will be appreciated that by "length," reference the actual or straightened length of the curvilinear element is intended. A first element 212 can have a length, $L_1$, tuned to be receptive to the first characteristic frequency and each of the second and third elements 213 and 214 can have a length within an approximately ten percent variance of the length of the first element. Varying the lengths of the first set of radiative elements 212-214 can provide an improvement in the broadband properties of the driven antenna assembly, but it will be appreciated that a common antenna length, for example, the tuned antenna length $L_1$, can be utilized for the first set of radiative elements in while still maintain the enhanced band properties of the antenna. Each of the second set of radiative elements 216-218 have a length in a second range around a length of approximately four-fifths the tuned length associated with the characteristic frequency. In one implementation, the length of each of the second set of radiative elements 216-218 can be equal to four-fifths the length of a corresponding one of the first set of radiative elements 212-214. In the illustrated implementation, the antenna assembly 100 is designed to operate band of frequencies ranging from around 700 MHz to around 6 GHz continuously. To this end, the first curvilinear element 212 can have a length of approximately 4.25 inches, the second curvilinear element 213 can have a length of approximately 4.5 inches, and the third curvilinear element 214 can have a length of approximately 4 inches. The maximum height of each of the of the first set of curvilinear elements 212-214 above the ground reference 206 can be limited to approximately 2.5 inches. The lengths of the second set of radiative elements 216-218 can be cut to approximately four-fifths the length of the first set of radiative elements 212-214. Accordingly, the fourth radiative element 216 can have a length of around 3.5 inches, the fifth radiative element 217 can have a length on the order of 3.75 inches, and the sixth radiative element 218 can have a length of approximately 3.25 inches. Each element 212-214 and 216-218 can have a diameter of approximately one-sixteenth of an inch.

Figure 8:
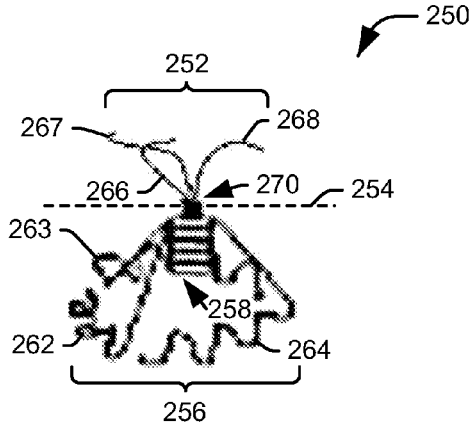
FIG. 8 illustrates a side view of a fifth exemplary implementation of an antenna assembly in accordance with an aspect of the present invention.

FIG. 8 illustrates a side view of a fifth exemplary implementation of an antenna assembly 250 in accordance with an aspect of the present invention. The illustrated antenna assembly 250 comprises a driven antenna assembly 252 located on a first side of an imaginary plane 254, and a ground reference 256. The driven antenna assembly 252 can be driven by an antenna feed 258 that is electrically connected to the driven antenna assembly approximately at the imaginary plane 254. The ground reference 256 may be comprised of any appropriate electrically conductive material such as, for example, copper or stainless steel.

In the illustrated implementation, the ground reference 256 is implemented as a series of curvilinear ground elements 262-264 that extend along the second side of the imaginary plane 254 to form an outline of a conical structure having a crenellated edge. Each of the curvilinear ground elements 262-264 can have a substantially linear portion that extends from a shield portion of the antenna feed 258 at an acute angle relative to the imaginary plane 254. In generally, the acute angle between each of the curvilinear ground elements 262-264 and the imaginary plane 254 will be between forty-five degrees and seventy degrees, and in the illustrated implementation, each curvilinear ground element forms a sixty degree angle with the imaginary plane. A crenellated portion of each of the curvilinear ground elements 262-264 can run substantially parallel to the imaginary plane as to form at least a portion of an elliptical or circular outline in a plane parallel to the imaginary plane.

The antenna feed 258 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 252 and allows a ground braid, or shield portion, of the coaxial cable to electrically connect to each of the discrete curvilinear elements comprising the ground reference 256. A dielectric material can be used to electrically insulate the center conductor and the driven antenna assembly 252 from the ground reference 256.

The driven antenna assembly 252 comprises a set of curvilinear radiative antenna elements 266-268 that spiral outward from a common apex 270. It will be appreciated, however, that one element, two elements, or more than three elements can also be utilized in each set. The driven antenna assembly 252 and its constituent elements 266-268 are formed from a conductive material. The radiative elements 266-268 are electrically connected to the antenna feed 258 and one another at respective first ends at the apex 270. Each of the radiative elements 266-268 are curvilinear and radiate away from the apex 270. In the illustrated implementation, the curvilinear elements extend away from the apex 270 near a desired horizontal radius from the apex at a first rate of ascent, and then proceed at a second rate of ascent that is less than the first rate of ascent. It will be appreciated, however, that in other implementations, the second rate of ascent can be greater than the first rate of ascent. Accordingly, the maximum vertical extent of the curvilinear elements 266-268, and thus the vertical profile of the antenna assembly 250, can be limited without a significant loss of sensitivity in the lower frequency portion of the band. The vertical profile and ground plane radius of the assembly can be further reduced through use of the discrete curvilinear ground elements 262-264, greatly reducing the amount of space necessary to implement the antenna assembly.

In the illustrated implementation, the curvilinear ground elements 262-264 are oriented such that respective first, second, and third elements are spaced evenly as they leave the shield portion of the antenna feed, that is, at intervals of one-hundred and twenty degrees. The respective first, second, and third radiative elements 266-268 are oriented such that they are spaced evenly as they leave the apex, at intervals of one-hundred and twenty degrees. Each of the set of curvilinear ground elements 262-264 has a length within a first range of lengths associated with a first characteristic frequency. It will be appreciated that by "length," reference the actual or straightened length of the curvilinear element is intended. A first curvilinear ground element 262 can have a length, $L_1$, the second and third curvilinear ground elements 263 and 264 can have a length within an approximately ten percent variance of the length of the first element. Varying the lengths of the curvilinear ground elements 262-264 can provide an improvement in the broadband properties of the antenna assembly, but it will be appreciated that a common antenna length, for example, $L_1$, can be utilized while still maintaining the enhanced band properties of the device.

Each of the radiative elements 266-268 have a length within a second range of lengths associated with a second characteristic frequency. For example, the First radiative element 266 can have a length, $L_2$, tuned to be receptive to the second characteristic frequency and each of the second and third radiative elements 267 and 268 can have a length within an approximately ten percent variance of the length of the first element. In one implementation, the antenna assembly 250 is designed to operate the three ISM bands of radio frequencies, including a first frequency band around 912-928 MHz, a second frequency band around 2.4 GHz, and a third frequency band around 5-6 GHz. The three curvilinear ground elements can be cut to lengths associated with the first and lowest frequency band, such that the first curvilinear ground element 262 can have a length of approximately 5.81 inches, the second curvilinear ground element 263 can have a length of approximately 5.63 inches, and the third curvilinear ground element 264 can have a length of approximately 6 inches. The lengths of the second set of radiative elements 266-268 can be cut to tune the antenna to the second frequency band, such that the first radiative element 266 can have a length of approximately 0.81 inches, the second radiative element 267 can have a length of approximately 0.69 inches, and the third radiative element 268 can have a length of approximately 0.94 inches. Capacitive and inductive interaction among the various elements 262-264 and 266-268 increase the sensitivity of the antenna 250 in the third frequency band. Each of the radiative elements 266-268 can have a diameter of approximately one-sixteenth of an inch.

Figure 9:
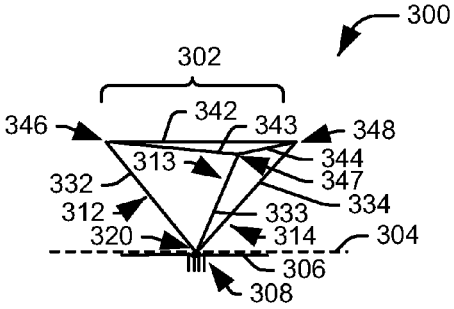
FIG. 9 illustrates a side view of a sixth exemplary implementation of an antenna assembly in accordance with an aspect of the present invention.

FIG. 9 illustrates a sixth exemplary implementation of an antenna assembly 300 in accordance with an aspect of the present invention. The illustrated antenna assembly 300 comprises a driven antenna assembly 302 located on a first side of an imaginary plane 304, and a ground reference 306 located at the imaginary plane or on a second side of the imaginary plane. In the illustrated implementation, the ground reference 306 is illustrated as planar, but it will be appreciated that other configurations of the ground plane can be utilized within the illustrated antenna assembly. The driven antenna assembly 302 can be driven by an antenna feed that is electrically connected to the driven antenna assembly approximately at the imaginary plane 304.

The antenna feed 308 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 302 and allows a ground braid of the coaxial cable to electrically connect to the ground reference 306. A dielectric material can be used to electrically insulate the center conductor and the driven antenna assembly 302 from the ground reference 306.

The driven antenna assembly 302 comprises three radiative elements 312-314 that extend outward from a common apex 320. The driven antenna assembly 302 and its constituent elements 312-314 are formed from a conductive material. The radiative elements 312-314 are electrically connected to the antenna feed 308 and one another at respective first ends at the apex 320. The radiative elements 312-314 comprise respective first linear segments 332-334 that extend away from the apex 320 at an acute angle relative to the imaginary plane 304, and respective second linear elements 336-338 that extend in a direction substantially parallel to the imaginary plane. Each first segment 332-334 is connected to its associated second segment 336-338 at an acute angle at a vertex 346-348. In accordance with an aspect of the invention, each second linear segment 342-344 can extend from their associated vertex 346-348 to the vertex of another radiative element 312-314, such that each radiative element has a second end terminating on the vertex of another radiative element, forming the outline of an inverted pyramid. By bending the radiative elements 312-314 into the illustrated pyramidal shape in this manner, an additional degree of capacitive and inductive coupling is provided such that the pyramidal shape allows for a significant reduction in the vertical profile of the antenna 300.

Figure 10:
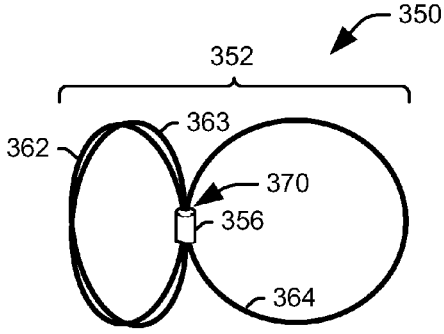
FIG. 10 illustrates a side view of a seventh exemplary implementation of an antenna assembly in accordance with an aspect of the present invention.

FIG. 10 illustrates a seventh exemplary implementation of an antenna assembly 350 in accordance with an aspect of the present invention. The illustrated antenna assembly 350 comprises a driven antenna assembly 352 and an SMA connector 356 having a center lead and a shield element that serves as a ground reference. The driven antenna assembly 352 comprises three radiative elements 362-364 that extend outward from a common apex 370. The driven antenna assembly 352 and its constituent elements 362-364 are formed from a conductive material. The radiative elements 362-364 are electrically connected to the center lead 358 and one another at respective first ends at the apex 370. The radiative elements 362-364 comprise elliptical loops that extend away from the apex 370 and loop back to terminate on the shield element of the SMA connector 356. The radiative elements 362-364 are generally substantially circular, but can be compressed to reduce the horizontal footprint of the antenna. In accordance with an aspect of the invention, the antenna assembly 350 is designed with a characteristic lower bound frequency, and each radiative element 362-364 has a length approximately equal to a wavelength associated with the characteristic lower bound frequency. In the illustrated example, the characteristic lower bound frequency is around 300 MHz, and the length of each radiative element 362-364 is approximately 40 inches, allowing the antenna 350 to be sensitive across at least dual frequency bands of 310-325 MHz and 915-917 MHz.

Figure 11:
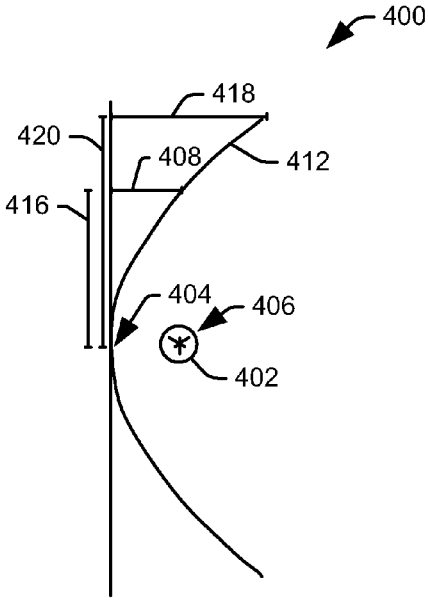
FIG. 11 illustrates a cross sectional view of a parabolic reflector dish for directing radiation received at and transmitted from an omni-directional enhanced band antenna to provide directionality to the antenna in accordance with an aspect of the present invention.

FIG. 11 illustrates a cross sectional view of a parabolic reflector dish 400 for directing radiation received at and transmitted from an omni-directional enhanced band antenna 402 to provide directionality to the antenna in accordance with an aspect of the present invention. The parabolic reflector dish 400 is formed from a conductive material and shaped as a circular paraboloid that can be represented by the revolution of a parabola around its axis, wherein the parabola having dimensions as described herein, can be described by the formula:

$$y = \frac{x^2}{24} \qquad \text{Eq. 2}$$

The cross-sectional view represents a center plane in the parabolic reflector 400, wherein the center plane is a plane that encompasses an apex 404 of the parabolic reflector and a focal point 406 of the parabolic reflector. It will be appreciated that while there are a number of planes that encompass these two points, the parabolic reflector 400 is a circular paraboloid, and thus all of these planes will produce substantially identical cross-sectional views. In the cross sectional plane, a horizontal axis represents the y variable and a vertical axis represents the x variable, with the origin at the apex 404 of the parabolic reflector 400, In accordance with an aspect of the present invention, the parabolic reflector dish 400 is configured such that the focal depth 408 of the dish is well within a volume defined by the dish. For example, the parabolic reflector dish 400 can be continued past the focal point 406 to a point where a line tangent to the edge 412 of the dish forms an angle between fifty-five and sixty degrees with an axis of dish. By configuring the dish to have a focal point within the volume of the dish, significant electromagnetic energy that might otherwise escape around the edge 412 of the dish is redirected along the axis of the dish. Accordingly, the directionality, and corresponding gain, of the enhanced band antenna 402 located at the focal point 406 of the dish 400 can be significantly increased, greatly enhancing the utility of the antenna for point-to-point communications.

In the illustrated implementation, the parabolic reflector 400 is configured for a wide band antenna 402 sensitive to a frequency band between 2.4 GHz and 11 GHz. The focal point 406 of the dish is located at point six inches from the apex. The parabolic reflector dish 400 has a focal point radius 416 of twelve inches. The dish has a depth 418 of thirteen and one-half inches, and a maximum radius 420 of eighteen inches. Using the illustrated parabolic reflector dish, a gain of the order of 25-35 dBi can be realized.

Figure 12:
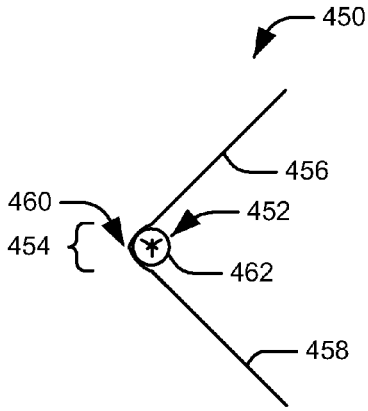
FIG. 12 illustrates a cross sectional view of a folded sheet reflector for providing directionality to an omnidirectional enhanced band antenna assembly in accordance with an aspect of the present invention.

FIG. 12 illustrates a cross-sectional view of a folded sheet reflector 450 for providing directionality to an omni-directional enhanced band antenna assembly 452 in accordance with an aspect of the present invention. The folded sheet reflector 450 is folded along a vertex 454 and extends from the vertex in two substantially planar conductive members 456 and 458. In the illustrated implementation, the folded sheet reflector 450 is folded at an angle of approximately ninety degrees at the vertex 454 and each planar is substantially rectangular, extending to a length of twelve inches with a width of seven inches. In accordance with an aspect of the present invention, the antenna assembly 452 is placed immediately adjacent to a center point 460 of the vertex, such that a ground reference 462 of the antenna is physically and electrically connected to the folded sheet reflector 450. It will be appreciated that the planar members 456 and 458 can be slightly deformed near the vertex to accommodate the antenna assembly 452. This electrical connection between the ground reference 462 and the folded sheet 450 substantially mitigates the effects of any mismatch in impedance at the antenna assembly, allowing for significant increase of the directionality, and corresponding gain, of the enhanced band antenna 452, greatly enhancing the utility of the antenna for point-to-point communications. Using the illustrated folded sheet reflector 450, a gain of the order of 10 dBi can be realized.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

Having described the invention, I claim:

1. An antenna assembly for receiving and transmitting radio frequency signals over an enhanced frequency band comprising:

a first radiative element having a first end, a second end, and an associated length, and comprised of an electrically conductive material, the first end of the first radiative element electrically connected to an antenna feed at an apex and at least a portion of the first radiative element being disposed outwardly away from the apex at an acute angle relative to, and on a first side of, an imaginary plane intersecting the apex;

a second radiative element, having a first end and a second end and comprised of an electrically conductive material, the first end of the second radiative element electrically connected to the antenna feed and the first radiative element at the apex, and the second end of the second radiative element having an associated height above the imaginary plane that is less than the product of the length of the first element and the sine of the acute angle at which the first element is disposed outwardly from the apex; and an electrically conductive ground reference.

2. The assembly of claim 1, further comprising:

a first set of a plurality of radiative elements that includes the first radiative element, each of the first set of radiative elements being electrically connected to the antenna feed at the apex and comprised of an electrically conductive material, with at least a portion of each of the first set of radiative elements being disposed outwardly away from the apex at an acute angle relative to, and on a first side of the imaginary plane and having a length within a first range associated with a first characteristic frequency, such that the associated lengths of the first set of radiative elements are selected as to tune the antenna to the first characteristic frequency; and a second set of a plurality of radiative elements that includes the second radiative element, each of the second set of radiative elements being electrically connected to the antenna feed at the apex and comprised of an electrically conductive material, with at least a portion of each of the second set of radiative elements being disposed outwardly away from the apex at an acute angle relative to, and on a first side of the imaginary plane and having a length within a second range that does not overlap the first range.

3. The assembly of claim 2, the second range associated with the second set of elements being associated with a second characteristic frequency, such that the associated lengths of the second set of radiative elements are selected as to tune the antenna to the second characteristic frequency.

4. The assembly of claim 3, each of the first set of radiative elements and the second set of radiative elements being substantially linear.

5. The assembly of claim 3, each of the first set of radiative elements and the second set of radiative elements being curvilinear, such that the height of respective second ends of each of the first set of radiative elements and the second set of radiative elements is less than the product of the length of the first element and the sine of the acute angle at which the first element is disposed outwardly from the apex.

6. The assembly of claim 2, each of the second set of radiative elements having a length approximately four-fifths the length of a corresponding one of the first set of radiative elements.

7. The assembly of claim 6, each of the first set of radiative elements and the second set of radiative elements being substantially linear.

8. The assembly of claim 6, each of the first set of radiative elements and the second set of radiative elements being curvilinear, such that the height of respective second ends of each of the first set of radiative elements and the second set of radiative elements is less than the product of the length of the first element and the sine of the acute angle at which the first element is disposed outwardly from the apex.

9. The assembly of claim 1, each of the first radiative element and the second radiative element being a curvilinear element that is curved such that the second ends of the first and second radiative elements are located at a predetermined height above the imaginary plane.

10. The assembly of claim 1, each of the first and second radiative elements comprising a first linear segment that extends away from the apex at an acute angle relative to the imaginary plane and respective second linear elements that extend in a direction substantially parallel to the imaginary plane, each first linear segment being connected to its associated second linear segment at a vertex and each second linear segment extending its associated vertex to the vertex of another radiative element.

11. The assembly of claim 1, the second radiative element comprising an elliptical loop beginning at the apex and terminating at the electrically conductive ground reference, the second radiative element being tuned to a characteristic frequency, the second radiative element having a length substantially equal to a wavelength associated with the characteristic frequency.

12. A parabolic reflector dish formed from a conductive material shaped as a circular paraboloid having an axis passing through an apex of the paraboloid and a focal point of the parabolic reflector dish, the parabolic reflector dish extending to a point to which a line tangent to an edge of the circular paraboloid forms an angle between fifty-five and sixty degrees with the axis, the antenna assembly of claim 1 being mounted at the focal point of the parabolic reflector dish as to direct electromagnetic radiation from the antenna assembly along the axis of the parabolic reflector dish.

13. A folded sheet reflector comprising:

two substantially planar conductive members joined along an edge to form a vertex; and the antenna assembly of claim 1, positioned at a center point of the vertex such that the electrically conductive ground reference is electrically connected to the two substantially planar conductive members.

14. The antenna assembly of claim 1, wherein the electrically conductive ground reference comprises a plurality of discrete curvilinear elements, each of the plurality of discrete curvilinear elements extending on a second side of the imaginary plane at an acute angle relative to the imaginary plane and terminating in a crenellated edge substantially parallel to the imaginary plane.

15. An antenna assembly for receiving and transmitting radio frequency signals over an enhanced frequency band comprising:

an electrically conductive ground reference; and a set of a plurality of curvilinear radiative elements, each of the set of radiative elements being electrically connected at respective first ends to an antenna feed at an apex and comprised of an electrically conductive material, at least a portion of each of the set of radiative elements being disposed outwardly away from the apex on a first side of the imaginary plane and each of the set of curvilinear elements having a length tuned to a first characteristic frequency, being curved such that respective second ends of the set of radiative elements are located below a predetermined height above the imaginary plane.

16. The antenna assembly of claim 15, the predetermined height being equal to approximately one quarter of a wavelength associated with a second characteristic frequency of the antenna assembly.

17. The antenna assembly of claim 15, the set of a plurality of curvilinear elements comprising a first set of curvilinear elements and the antenna assembly further comprising a second set of a plurality of curvilinear radiative elements, each of the second set of radiative elements being electrically connected at respective first ends to the antenna feed at the apex, having a length tuned to a second characteristic frequency, and being comprised of an electrically conductive material, at least a portion of each of the second set of radiative elements being disposed outwardly away from the apex on the first side of the imaginary plane.

18. An antenna assembly for receiving and transmitting radio frequency signals over an enhanced frequency band comprising:

a first set of a plurality of radiative elements, each of the first set of radiative elements being electrically connected to an antenna feed at an apex and comprised of an electrically conductive material, with at least a portion of each of the first set of radiative elements being disposed outwardly away from the apex at an acute angle relative to, and on a first side of the imaginary plane and each of the first set of radiative elements having a length within a first range associated with a first characteristic frequency, such that the associated lengths of the first set of radiative elements are selected as to tune the antenna to the first characteristic frequency; and a second set of a plurality of radiative elements, each of the second set of radiative elements being electrically connected to the antenna feed at the apex and comprised of an electrically conductive material, with at least a portion of each of the second set of radiative elements being disposed outwardly away from the apex at an acute angle relative to, and on a first side of the imaginary plane, each of the second set of radiative elements having a length within a second range that does not overlap the first range; and an electrically conductive ground reference.

19. The assembly of claim 18, the second range associated with the second set of elements being associated with a second characteristic frequency, such that the associated lengths of the second set of radiative elements are selected as to tune the antenna to the second characteristic frequency.

20. The assembly of claim 18, each of the second set of radiative elements having a length approximately four-fifths the length of a corresponding one of the first set of radiative elements.

* * * * *